US011160399B2

(12) United States Patent
Pietracatella

(10) Patent No.: US 11,160,399 B2
(45) Date of Patent: Nov. 2, 2021

(54) NECK PILLOW WITH STORAGE CAPABILITY

(71) Applicant: Lisa Pietracatella, Staten Island, NY (US)

(72) Inventor: Lisa Pietracatella, Staten Island, NY (US)

( * ) Notice: Subject to any disclaimer, the term of this patent is extended or adjusted under 35 U.S.C. 154(b) by 0 days.

(21) Appl. No.: 16/260,233

(22) Filed: Jan. 29, 2019

(65) Prior Publication Data

US 2019/0231100 A1 Aug. 1, 2019

Related U.S. Application Data

(60) Provisional application No. 62/623,559, filed on Jan. 30, 2018.

(51) Int. Cl.

| | |
|---|---|
| ***A47G 9/10*** | (2006.01) |
| ***A47C 7/38*** | (2006.01) |
| ***A61H 1/00*** | (2006.01) |

(52) U.S. Cl.

CPC ..... *A47G 9/1081* (2013.01); *A47C 7/383* (2013.01); *A47G 9/1036* (2013.01); *A47G 9/1045* (2013.01); *A61H 1/00* (2013.01)

(58) Field of Classification Search

CPC .. A47G 9/1081; A47G 9/1045; A47G 9/1036; A47C 7/383; A61H 1/00; A61H 1/0296; A61H 2205/04; A61H 2205/02; A61H 2201/10; A61H 2201/0134; A61H 2201/0157; A61H 2201/1604; A61H 2201/1609

See application file for complete search history.

(56) References Cited

U.S. PATENT DOCUMENTS

| | | | | |
|---|---|---|---|---|
| 9,155,409 | B2 | 10/2015 | Cohen | |
| 2007/0033737 | A1* | 2/2007 | Melton | A47C 7/383 5/640 |
| 2009/0019641 | A1* | 1/2009 | Ali | B60N 2/885 5/636 |
| 2014/0310877 | A1* | 10/2014 | Sternlight | A47C 31/00 5/639 |

(Continued)

FOREIGN PATENT DOCUMENTS

| | | |
|---|---|---|
| CN | 202375697 | 8/2012 |
| CN | 203073981 | 7/2013 |

(Continued)

*Primary Examiner* — Eric J Kurilla

(74) *Attorney, Agent, or Firm* — Gearhart Law LLC

(57) ABSTRACT

Disclosed embodiments provide a neck pillow with storage capability. In embodiments, the neck pillow can open to reveal internal compartments, suitable for storage of small personal items. In this way, the neck pillow can also serve as a carrying mechanism as well as functioning as a traditional neck pillow. In this way, one can carry the neck pillow and personal items conveniently. This makes neck pillows of disclosed embodiments convenient for a variety of activities such as relaxing at the beach, concerts, movies, sporting events, and anywhere else where sitting for prolonged periods may occur. Further, the neck pillow may have a pocket to receive a heating and/or cooling pack to be used in conjunction with an individual who has suffered a head or neck injury. Here, the neck pillow may be utilized to promote proper body alignment and provide therapeutic relief.

27 Claims, 12 Drawing Sheets

(56) References Cited

U.S. PATENT DOCUMENTS

| | | | | |
|---|---|---|---|---|
| 2016/0302596 | A1* | 10/2016 | Ross | A47G 9/0215 |
| 2017/0000273 | A1 | 1/2017 | Mitchell | |
| 2018/0289183 | A1* | 10/2018 | Karl | A47G 9/1009 |
| 2019/0014914 | A1* | 1/2019 | Sternlight | A47C 21/026 |

FOREIGN PATENT DOCUMENTS

| | | | |
|---|---|---|---|
| GB | 2506112 | A | 3/2014 |
| KR | 101672972 | B1 | 9/2016 |

* cited by examiner

NECK PILLOW WITH STORAGE CAPABILITY

CLAIM OF PRIORITY

This application claims priority to U.S. Application Ser. No. 62/623,559 filed on Jan. 30, 2018, the contents of which are herein incorporated by reference in its entirety.

FIELD OF THE EMBODIMENTS

The present invention relates generally to pillows, and more particularly, to a neck pillow with storage capability.

BACKGROUND OF THE EMBODIMENTS

A neck pillow is an excellent way of promoting comfort, and can also provide relief to a person. Neck pillows are commonly used when a person is seated for a prolonged period and desires some form of neck and/or head support.

There are additional benefits in using neck pillows. These include alleviation of neck pain and discomfort. Whether it is caused by a sleeping position or lack of support, neck pain can often be alleviated by utilizing a neck pillow. Furthermore, jaw pain, alignment, and breathing are additional potential health benefits of neck pillows. This is because the positioning of one's neck can affect breathing and also lead to back and head pain. Providing support and cushioning to the area helps keep the vertebrae lined properly, which can significantly reduce many aches, pains, and other adverse symptoms. Further, neck pillows may be utilized after sustaining a neck and/or head injury in order to promote ideal body alignment and prevent cervical (neck) pain. It is therefore desirable to have improvements in neck pillows.

Review of Related Technology

U.S. Patent Application 2017/0000273 pertains to a neck pillow used by a person in need. The neck pillow contains an insert with a plurality of openings to allow air flow between a first side and a second side of the neck pillow. A pocket is included for storing personal items such as a cellular phone.

U.S. Pat. No. 9,155,409 pertains to a pillow including a pillow body having a medial region and a pair of legs that extend from the medial region to define an opening there between, an interior core disposed within the pillow body, a cover and disposed around the interior core, and a plurality of pockets to removably store travel items. Each of the pockets is coupled with the cover of the pillow body. Each of the pockets extend inward into the interior core of the pillow body.

Various devices are known in the art. However, their structure and means of operation are substantially different from the present disclosure. The other inventions also fail to solve all the problems taught by the present disclosure. At least one embodiment of this invention is presented in the drawings below and will be described in more detail herein.

SUMMARY OF THE EMBODIMENTS

One aspect of disclosed embodiments includes a neck pillow comprising: a bottom portion; a top portion, wherein the top portion is coupled to the bottom portion; and at least one compartment formed within one of the top portion or bottom portion of the neck pillow.

In another aspect, the neck pillow further comprises a coupling mechanism configured and disposed to affix the top portion to the bottom portion.

In another aspect, the neck pillow coupling mechanism comprises a hinge.

In another aspect, the neck pillow coupling mechanism comprises a fabric flap.

In another aspect, the neck pillow further comprises a fastening mechanism configured and disposed to secure the top portion to the bottom portion in a closed configuration.

In another aspect, the neck pillow fastening mechanism comprises a hook-and-loop fastener.

In another aspect, the neck pillow fastening mechanism comprises a snap.

In another aspect, the neck pillow fastening mechanism comprises a zipper.

In another aspect, the neck pillow includes a first compartment and a second compartment and, in some embodiments, a third compartment.

In another aspect, the first compartment is disposed on a first outer side of the neck pillow and wherein the second compartment is disposed on a second outer side of the neck pillow. The third compartment, if present, may also be on an outer side of the neck pillow.

In another aspect, the neck pillow further comprises a channel disposed between the first compartment and the second compartment.

In another aspect, the neck pillow further includes a pocket disposed on an outer surface of the neck pillow.

In another aspect, the pocket is a waterproof pocket.

In another aspect, the neck pillow further comprises a clip disposed on a rear portion of the neck pillow.

In another aspect, the neck pillow further comprises a loop disposed on a rear portion of the neck pillow.

In another aspect, the neck pillow comprises an outer surface comprised of plastic.

In another aspect, the neck pillow comprises an outer surface comprised of vinyl.

In another aspect, the neck pillow comprises an outer surface comprised of leather.

In another aspect, the neck pillow comprises an outer surface comprised of silk.

In another aspect, the neck pillow comprises an outer surface comprised of cotton.

In another aspect, the neck pillow comprises an outer surface comprised of wool.

In another aspect, the neck pillow comprises a pliable member disposed within the pillow.

In another aspect, the pliable member is comprised of metal.

In another aspect, the pliable member is comprised of plastic.

In another aspect, the pliable member is disposed around a contour of the neck pillow.

In another aspect, the neck pillow comprises a fill material comprised of foam.

In another aspect, the foam includes a polyurethane foam.

In another aspect, the foam includes a urethane foam.

Figure 1:
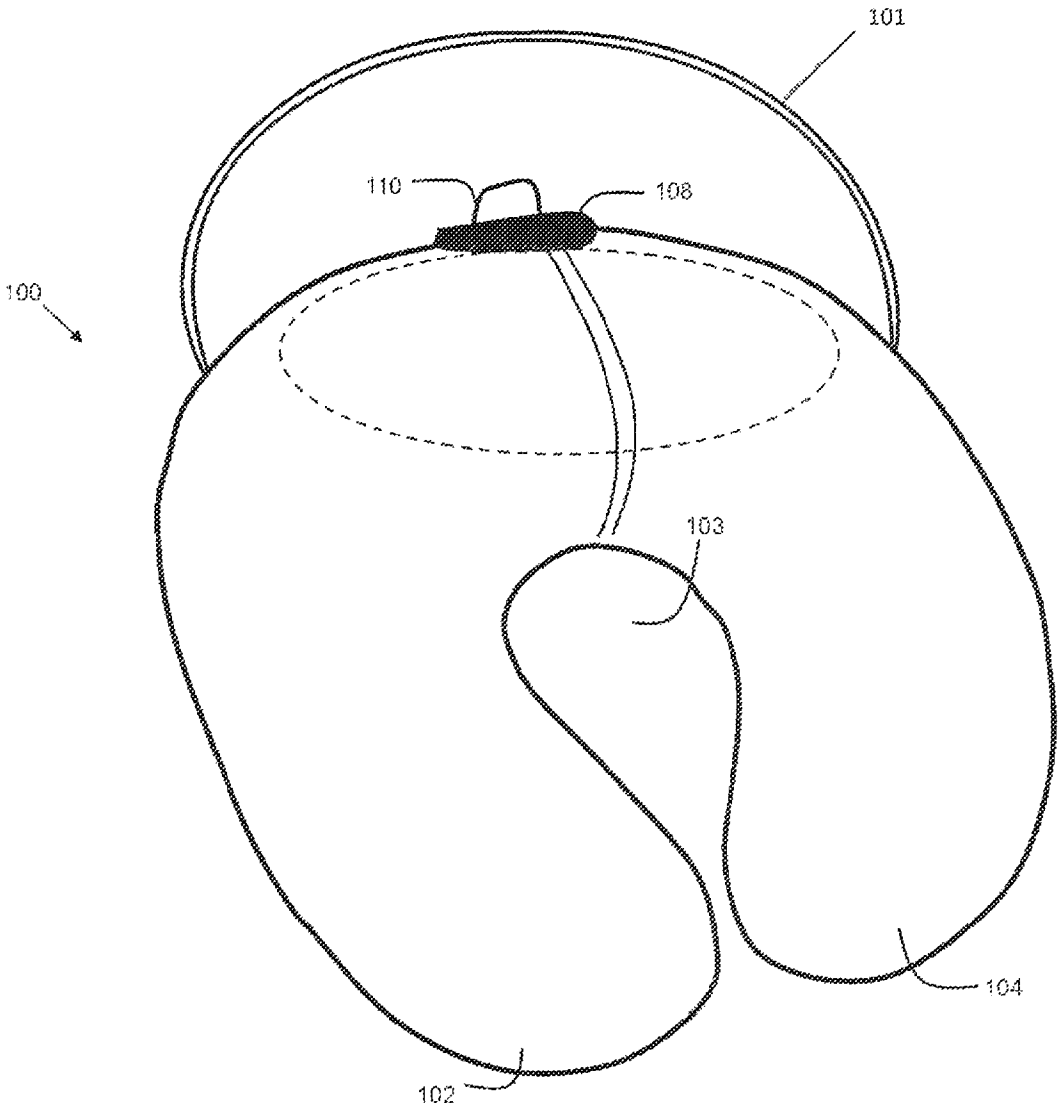
FIG. 1 shows a perspective view of an embodiment of the present invention.

The drawings contained herein are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION OF THE EMBODIMENTS

Disclosed embodiments provide a neck pillow with storage capability. In embodiments, the neck pillow can open to reveal internal compartments, suitable for storage of small personal items. In embodiments, there may be pockets or compartments affixed to an outer surface of the neck pillow for ice packs, heat packs, cell phones, sunglasses, etc. In this way, the neck pillow can also serve as a carrying mechanism as well as functioning as a traditional neck pillow. This enables one to carry the neck pillow and personal items conveniently. This makes neck pillows of disclosed embodiments convenient for a number of uses including, but not limited to, the beach, concerts, movies, sporting events, travel, and anywhere else where sitting for prolonged periods may occur. Further, the neck pillow may be utilized in medical-type settings including but not limited to physical therapy, massage therapy, and chiropractic settings.

FIG. 1 shows a perspective view of an embodiment of the present invention. Neck pillow 100 is of a U-shape, comprising a first lobe 102 and a second lobe 104, forming an opening 103, in which a user can put his neck through during use of the pillow 100. The pillow 100 further comprises coupling mechanism 108 which secures the top and bottom portions of the pillow together. In embodiments, the coupling mechanism 108 can be a hinge, fabric flap, or other suitable mechanism to affix the top and bottom portions of the neck pillow 100. Embodiments may further include a loop or clip 110. Clip 110 may be used to hook the pillow 100 onto a clip or carabineer of a backpack, belt loop, or other suitable connection point. In embodiments, the loop or clip 110 is disposed on a rear portion of the neck pillow. This makes it convenient to carry the neck pillow of disclosed embodiments while walking. Further, a strap 101 may be utilized to secure the neck pillow 100 to a chair or other object to prevent undesired movement of the neck pillow 100 during use.

The neck pillow of disclosed embodiments may include a fill material. In embodiments, the fill material may include, but is not limited to, polyurethane foam, urethane foam, polyester fill, or other suitable material.

In some embodiments, the neck pillow of disclosed embodiments includes a fill material comprised of foam having a density of 0.9 to 1.7 lbs. per square foot and an indent load deflection (ILD) of 10 to 23 pounds. For the purposes of this disclosure, the ILD of a foam is defined as the amount of weight required to reduce a square block of foam of 16"×16"×4" thickness down to a thickness of 3".

In embodiments, the neck pillow is comprised of a foam of sufficient density such that it generally maintains the U-shape of the pillow, with a deflection of 5 to 10 percent with the weight 20 pounds applied to it. This allows for a comfortable amount of deflection when in use, as a user rests his/her head on the pillow, while still maintaining its form. In this way, as will be described in further detail, the neck pillow of disclosed embodiments can also serve as a carrier of small objects.

The neck pillow of disclosed embodiments may be covered or clad in a textile covering. In embodiments, the textile covering may include, but is not limited to, plastic, vinyl, leather, silk, cotton, nylon, wool, or other suitable textile.

Figure 2:
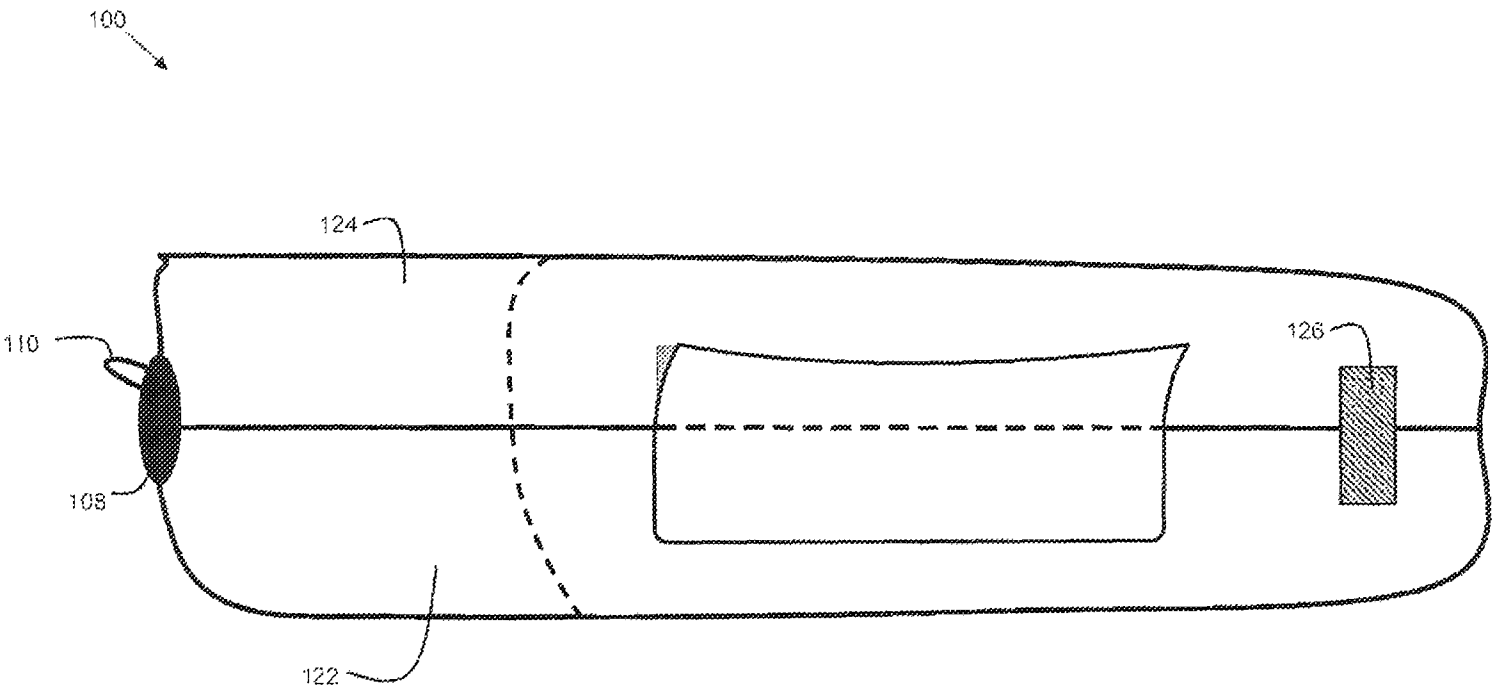
FIG. 2 shows a side view of an embodiment of the present invention.
Figure 3:
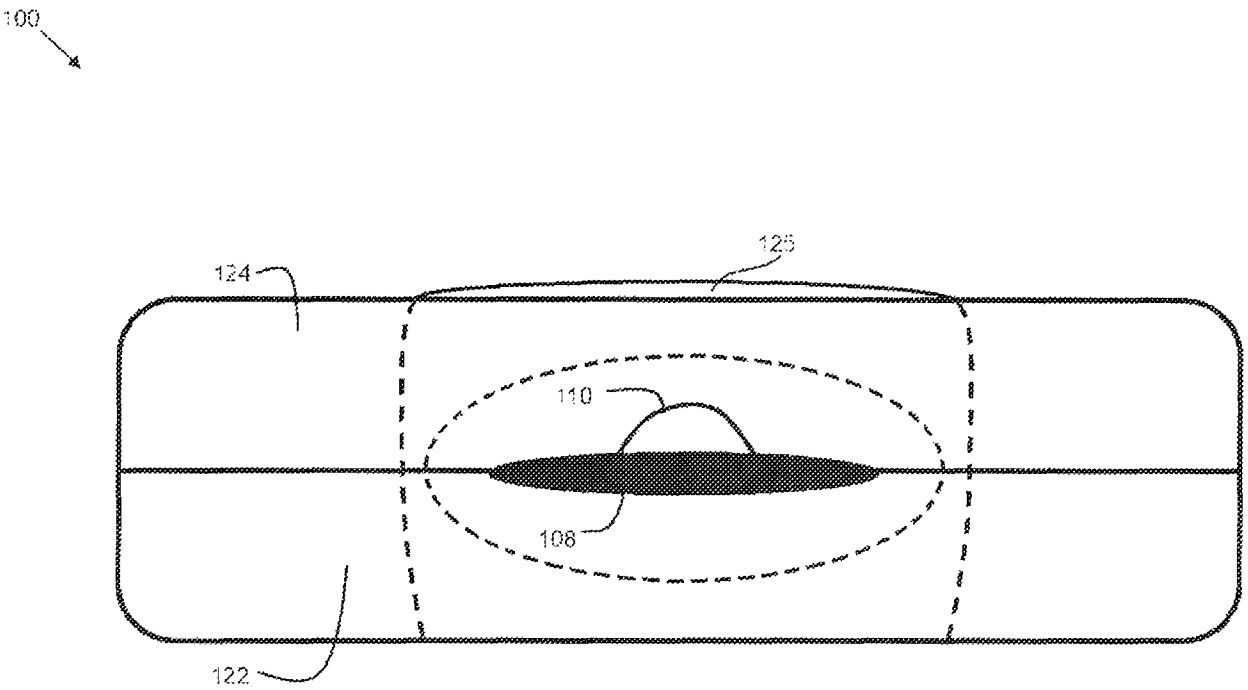
FIG. 3 shows a rear view of an embodiment of the present invention.

FIG. 2 shows a side view of the neck pillow of FIG. 1 in a closed configuration. In the side view of FIG. 2, it can be seen that there is a top portion 124 and a bottom portion 122. A fastening mechanism 126 may be used to secure the top portion 124 to the bottom portion 122 when the pillow is in a closed configuration as shown in FIG. 2. In embodiments, a similar fastening mechanism 126 may be on the opposite side of the neck pillow. In embodiments, the fastening mechanism 126 may include, but is not limited to, a hook-and-loop fastener, a snap, a clasp, or other suitable fastening mechanism. In yet other embodiments, a zipper may be used to secure the top portion 124 to the bottom portion 122. Similarly, FIG. 3 shows a rear view of the neck pillow of FIG. 1, indicating the coupling mechanism 108 that forms a permanent connection between the top portion 124 and the bottom portion 122. In embodiments, the top portion 124 and bottom portion 122 may both comprise the same fill/foam material. In other embodiments, the bottom portion 122 may be comprised of a fill/foam material that is stiffer than the fill/foam material of the top portion 124 in order to house various items for storage. Further, FIG. 3 shows an additional pocket 125 or compartment which is configured to receive a heating or cooling pack. This pocket 125 may be water proof to prevent condensation from a cooling pack from dampening the surrounding material. In some embodiments, the pocket 125 may be insulated to prevent injury to a user from prolonged heat or cold exposure as well as to prolong the life of any heating or cooling pack utilized.

Figure 4:
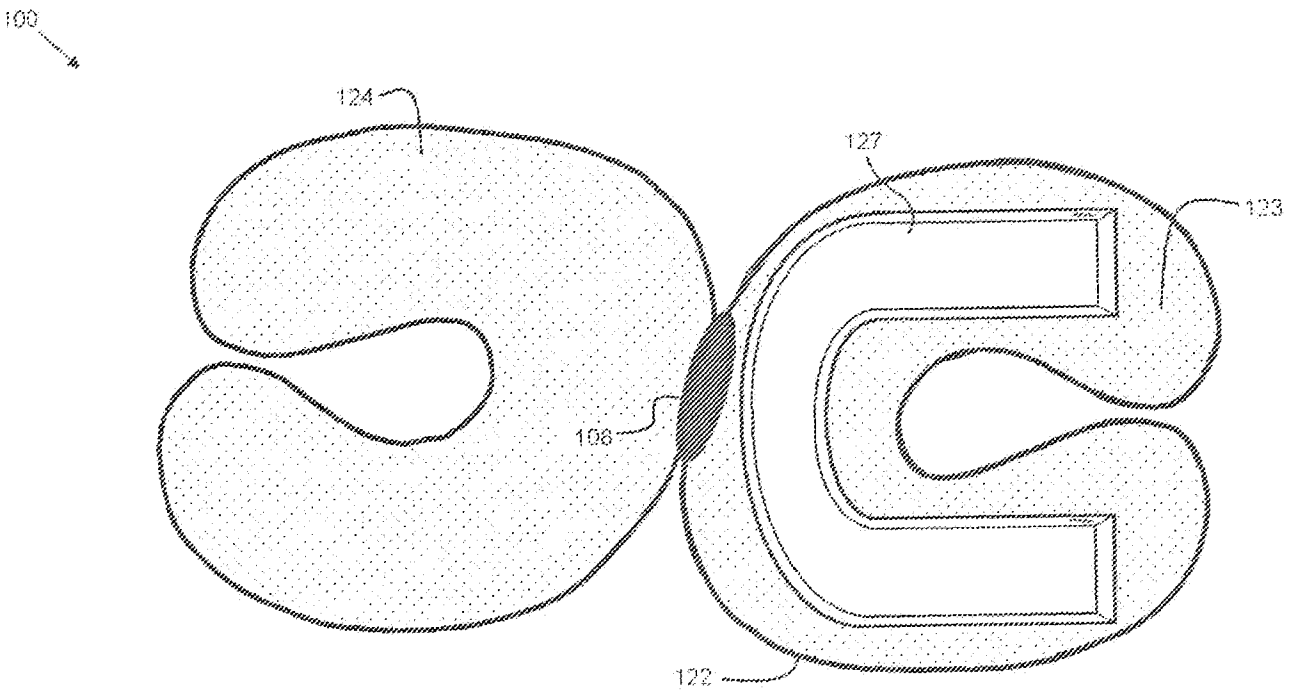
FIG. 4 shows a top-down open view of an embodiment of the present invention.

FIG. 4 shows a top-down open view of the neck pillow of FIG. 1. In embodiments, the top portion 124 is able to pivot at coupling mechanism 108, allowing the neck pillow 100 to open, revealing compartments 127 that are molded or cut out of the foam or fill material 123 in the bottom portion 122 forming a void or hollow for storage. While two compartments are shown in FIG. 4, other embodiments may have more or fewer compartments. In some embodiments, the compartments may be round, triangular, or other suitable shape.

Figure 5:
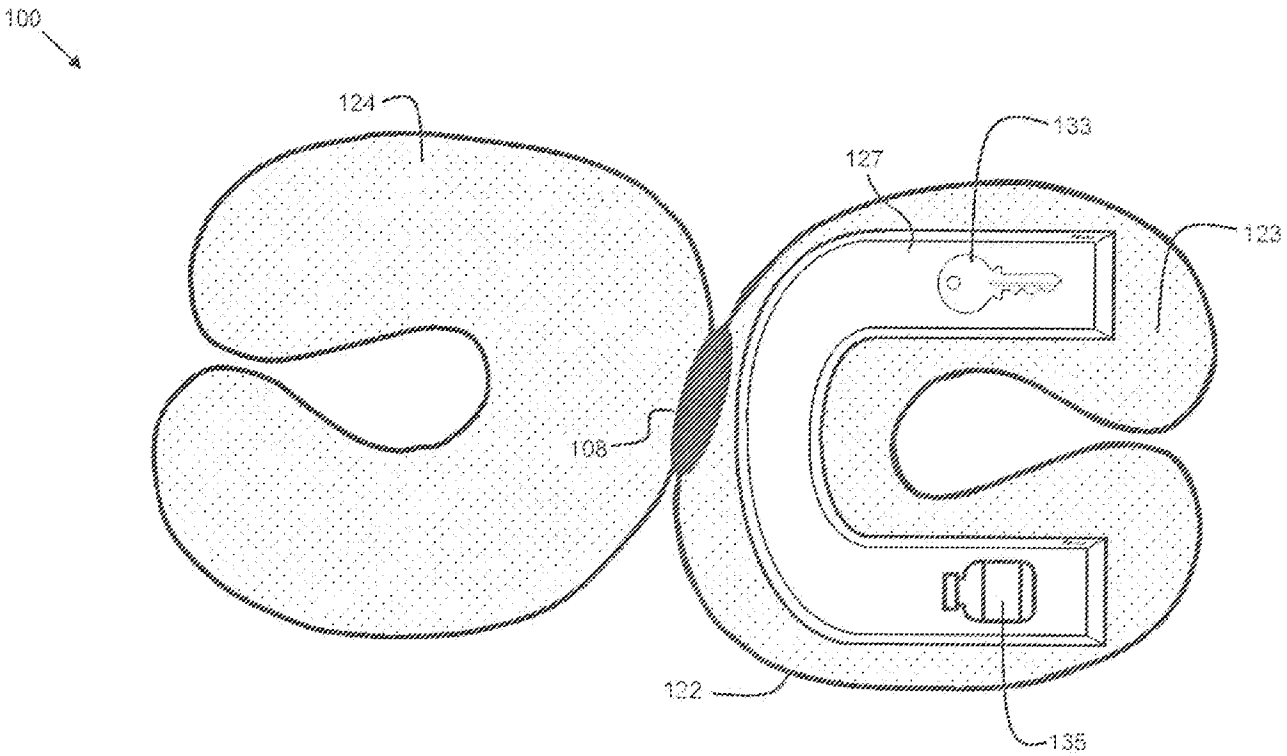
FIG. 5 shows a top-down open view of an example usage of an embodiment of the present invention.

FIG. 5 shows a top-down open view of an example usage of an embodiment of the present invention. Small personal items such as keys 133 and/or sunscreen 135 as well as money, medications, etc. are examples of items that may be stored in the compartment 127 of embodiments of the present invention.

Figure 6:
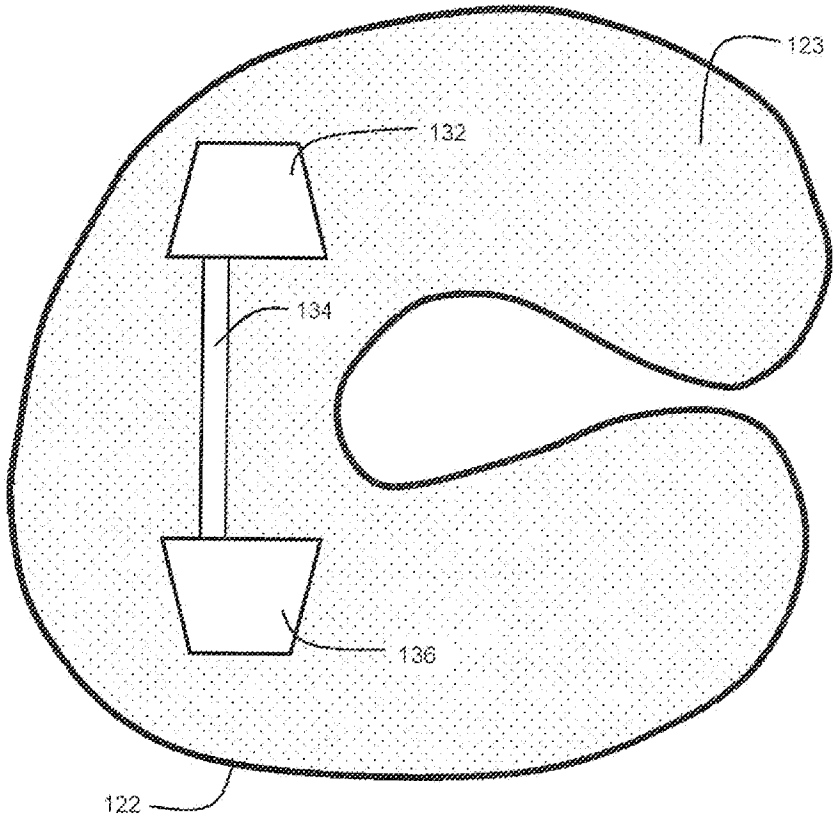
FIG. 6 shows a cutaway view of another embodiment of the present invention.

FIG. 6 shows a cutaway view of another embodiment of the present invention. In this view, a cutaway of bottom portion 122 is shown. In this embodiment, there may be two compartments, indicated as 132 and 136. A channel 134 is disposed between the two compartments. This embodiment is well suited for the installation of portable wireless speakers. For example, a Bluetooth™ wireless speaker set can be installed in the bottom portion 122 of the neck pillow. A first speaker can be installed in compartment 132 and a second speaker can be installed in compartment 136. A wire connecting the first speaker and second speaker (if required) can be positioned in channel 134. One of the speakers typically can house a Bluetooth™ transceiver. In this way, the speakers can be concealed within the neck pillow. Compartment 132 is disposed on one side of the neck pillow and compartment 136 is disposed on the other side of the neck pillow such that when the neck pillow is worn by a user, the speakers are each oriented near one of the user's ears to provide a stereo listening experience.

Figure 7:
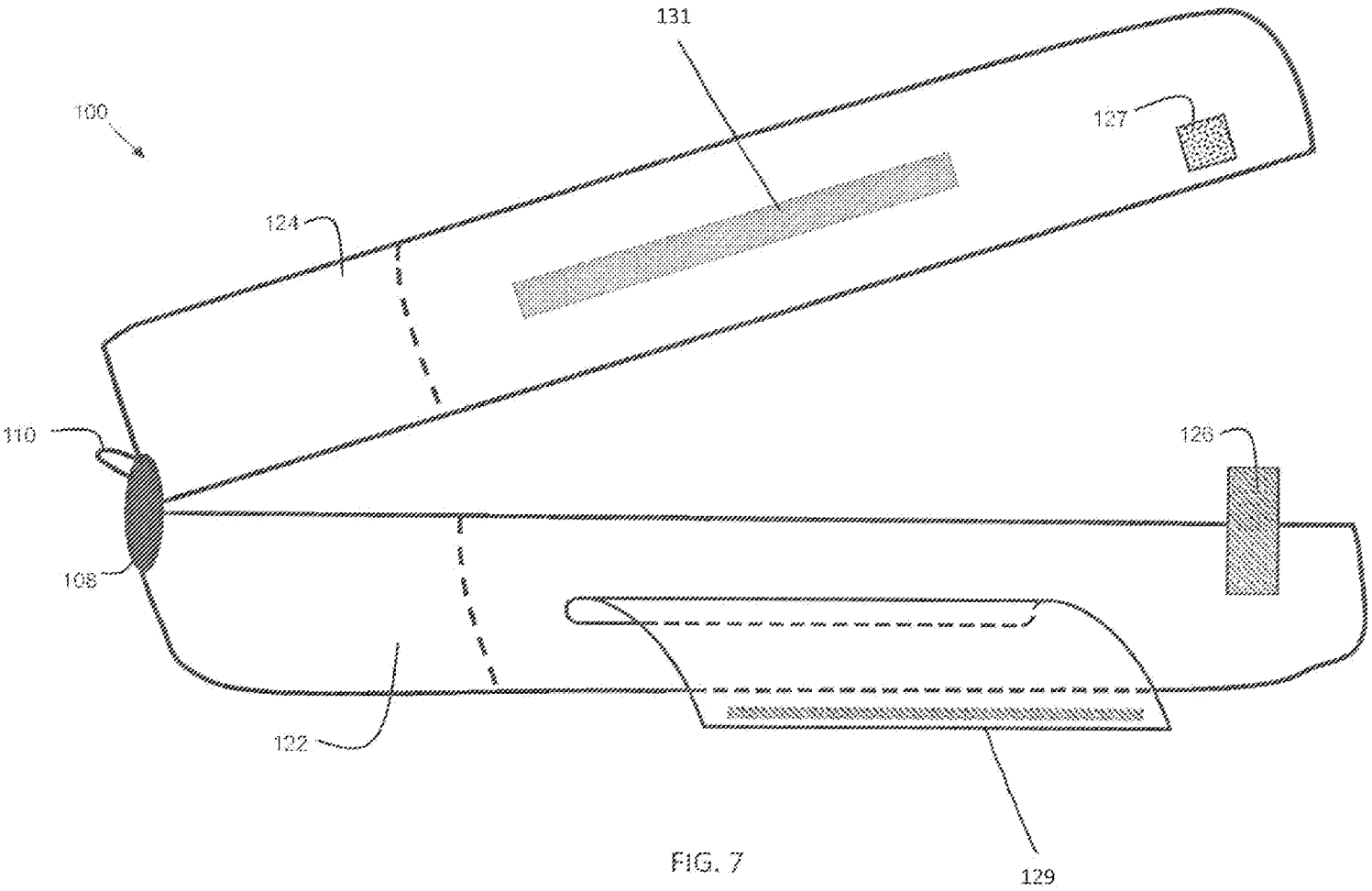
FIG. 7 shows a side view of an embodiment of the present invention in an open configuration.

FIG. 7 shows a side view of neck pillow 100 in an open configuration. The top portion 124 pivots at coupling mechanism 108 to allow the top portion 124 to be pulled away from the bottom portion 122 to allow access to the compartments within the pillow. In embodiments, a fastener 127 may be affixed to the top portion 124 to mechanically couple with the fastener 126 of the bottom portion 122. In embodiments, the fastening mechanism may include, but is not limited to, hook-and-loop fasteners, snaps, magnetic seals, zippers, clasps, buckles, and/or elastic bands. Other suitable fastening mechanisms may be used in other embodiments of the present invention. Further a pocket or compartment 129 may be used to hold items therein. The compartment 129 may be attached to an outer surface of the neck pillow 100. The compartment 129 may be attached to one of the top portion 124 or bottom portion 122. On an opposing portion, there is an attachment mechanism 131 to which the compartment 129 is removably secured such that the neck pillow 100 can be opened/closed as desired.

Figure 8:
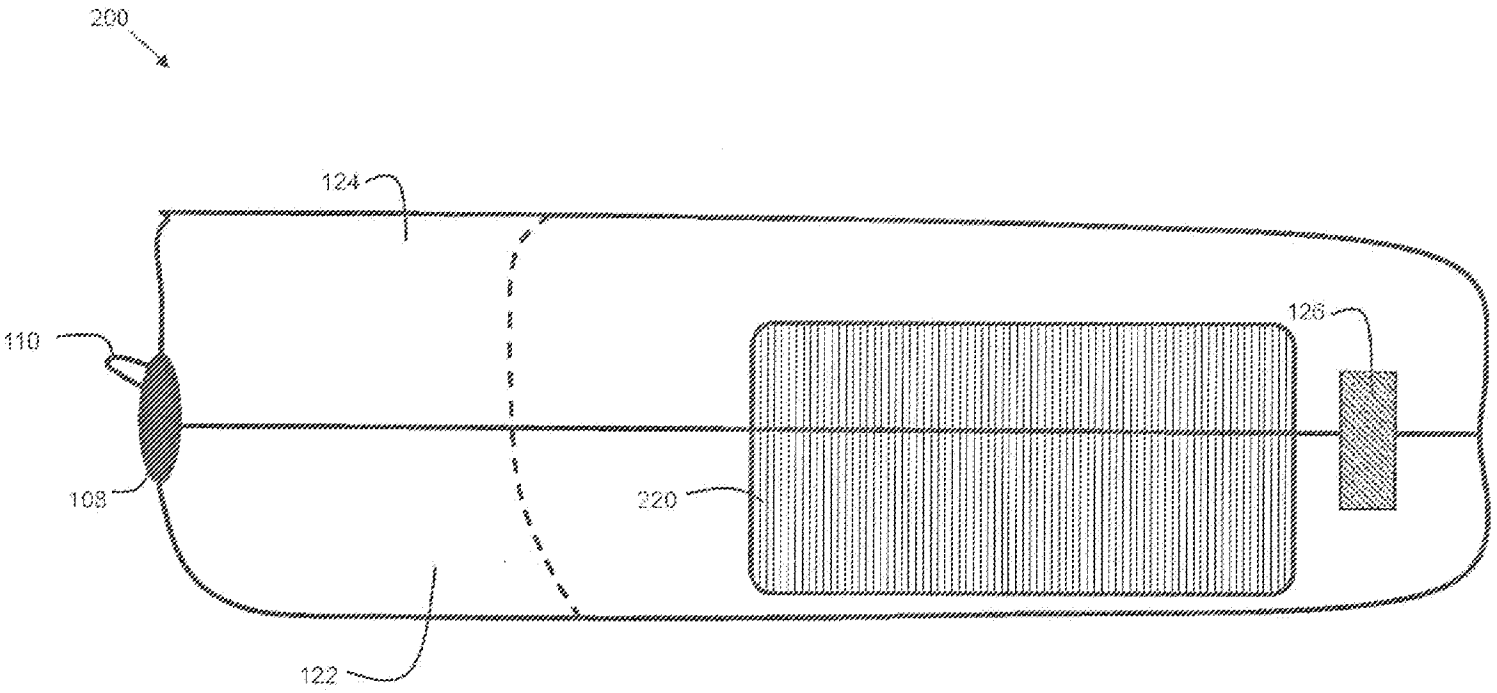
FIG. 8 shows a side view of another embodiment of the present invention.

FIG. 8 shows a side view of another embodiment of the present invention. Neck pillow 200 of FIG. 8 is similar to neck pillow 100 as described previously, with a key difference being the addition of a side pocket 220 disposed on an outer surface of the neck pillow. The side pocket 220 may be affixed to the bottom portion 122. Alternatively, the side pocket 220 may be affixed to the top portion 124. Some embodiments may include more than two side pockets. In some embodiments, the side pocket 220 may be waterproof. The side pocket 220 may be well suited for storing a portable electronic device such as a portable music player, sunglasses, mobile phone, etc. In this way, the embodiment of FIG. 8 provides additional convenience by providing storage that can be accessed without needing to open the neck pillow 200.

Figure 9:
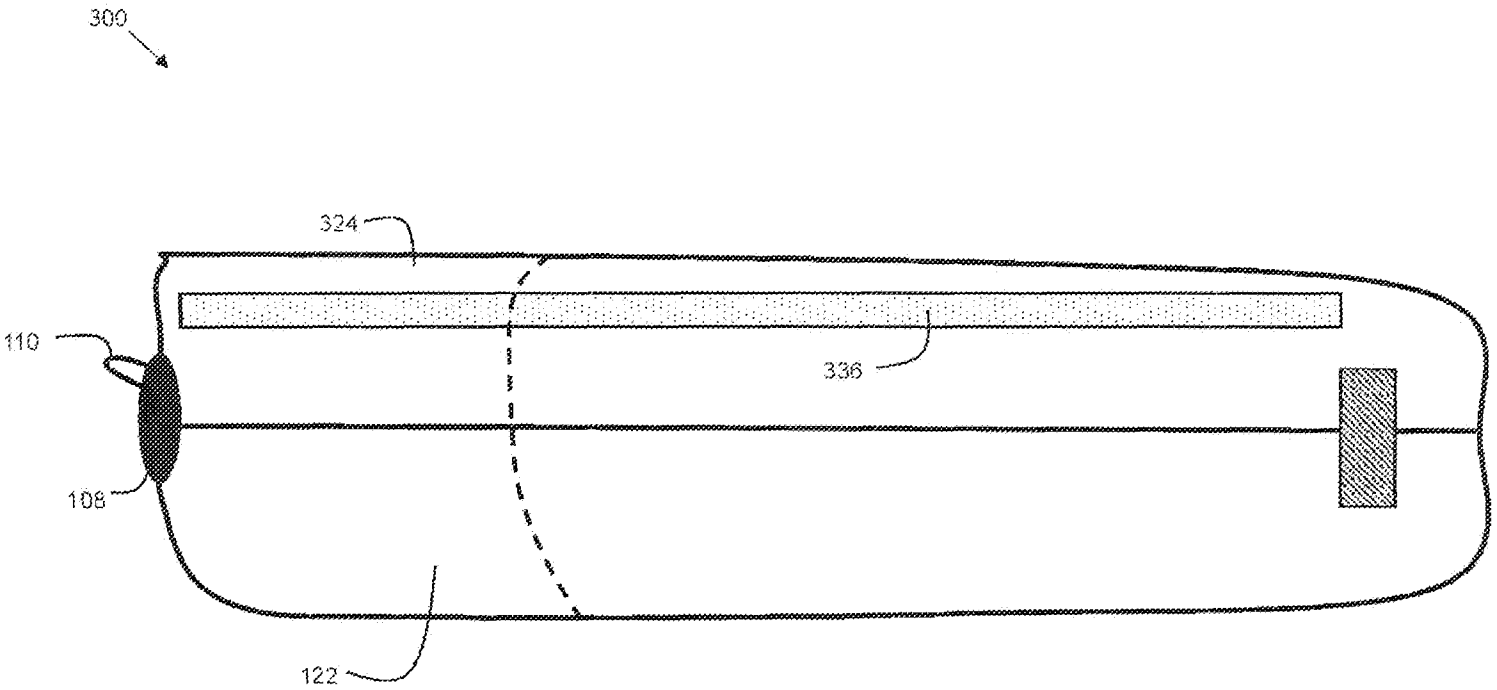
FIG. 9 shows a side view of another embodiment of the present invention.

FIG. 9 shows a side view of another embodiment of the present invention. Neck pillow 300 of FIG. 9 is similar to neck pillow 100 described previously, with a key difference being the addition of a pliable member 336 within the top portion 324 of pillow 300. The pliable member may be made of plastic or metal having a memory property, in that it substantially remains in the position it was placed. The pliable member 336 has a property such that when it is moved into a position it substantially remains in that position. Thus, when the user bends the pillow to adjust one of the lobes, the pillow substantially remains in the bent position. This allows the neck pillow of disclosed embodiments to be configured into a variety of positions for enhanced comfort during use.

Figure 10:
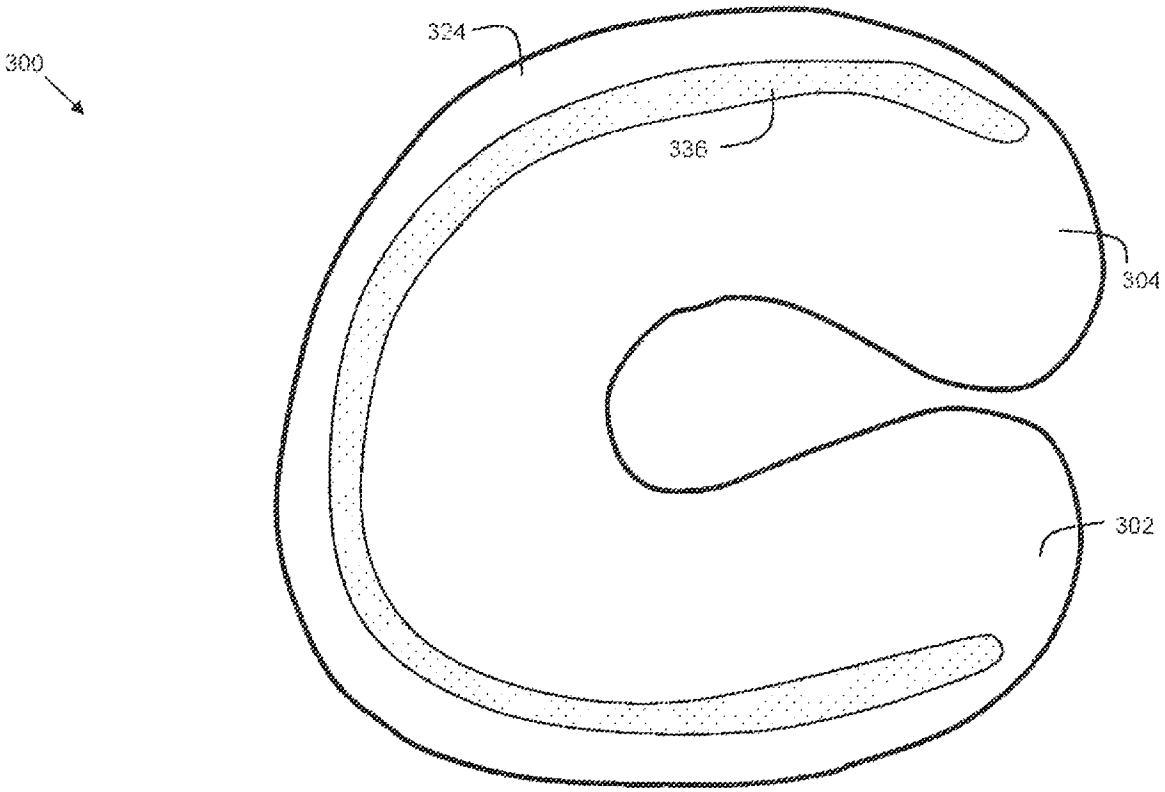
FIG. 10 shows a top-down cutaway view of the embodiment of FIG. 9.

FIG. 10 shows a top-down cutaway view of the embodiment of FIG. 9. In this view, it can be seen that pliable member 336 is disposed along the contour of the pillow, extending from a first lobe 302 to a second lobe 304.

Figure 11:
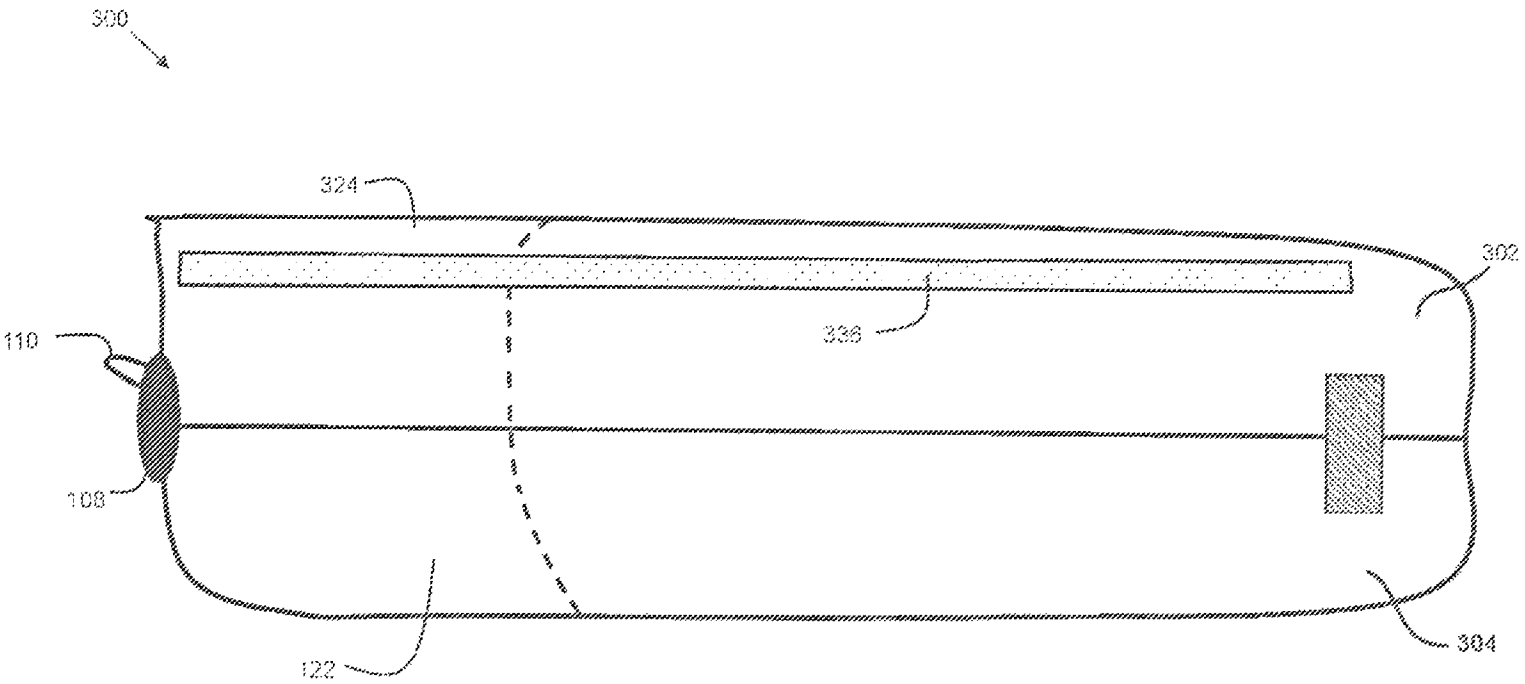
FIG. 11 shows a side view of an example usage of the embodiment of FIG. 9.
Figure 13:
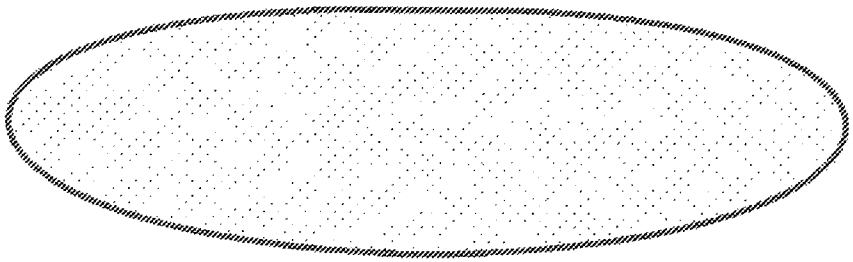
FIG. 13 shows a top view of an alternate example usage of the embodiment of FIG. 9.
Figure 12:
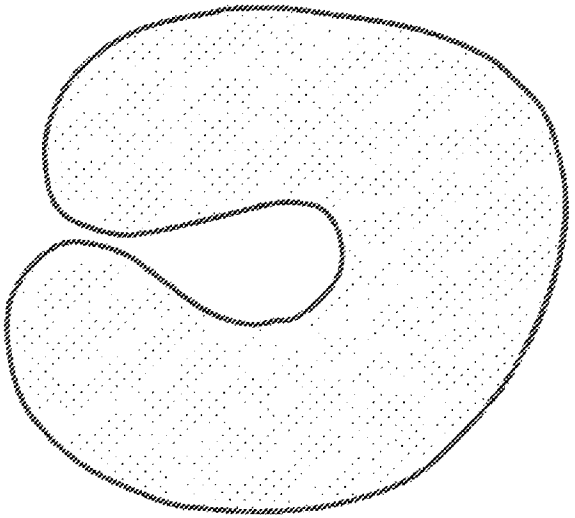
FIG. 12 shows a top view of an example usage of the embodiment of FIG. 9.

FIGS. 11-12 show a side and a top view, respectively, of an example usage of the embodiment of FIG. 9. In this view, it can be seen that the first lobe 302 and second lobe 304 are in a linear type relationship thereby "elongating" or "straightening" the pillow. Further, as shown, the first lobe 302 and the second lobe 304 can be bent thereby forming a "horseshoe" shape, as shown in FIG. 12, for positioning the pillow around the neck. In embodiments, a position of the pillow (i.e. straight, bent, etc.) is configured and maintained by pliable member 336.

As can now be appreciated, disclosed embodiments provide a neck pillow with storage capability. The neck pillow includes a top portion and a bottom portion, where the top portion is coupled to the bottom portion to reveal one or more internal compartments within the neck pillow. This allows for storage of small items within the neck pillow, enabling improved convenience while lounging, relaxing, or participating in other activities where a neck pillow is of use.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A neck pillow comprising:

a bottom portion having an outer surface, an inner surface, an attachment mechanism coupled to the outer surface, and at least two fasteners coupled to the outer surface, wherein the inner surface forms a recess having a shape complimentary to that of the outer surface;

a top portion having an outer surface, an inner surface, and a pocket, wherein the top portion is coupled to the bottom portion, wherein the top portion has at least two fastening mechanisms permanently affixed to an outer surface of the top portion, wherein the at least two fastening mechanisms are configured to selectively couple to the at least two fasteners of the bottom portion, and wherein the pocket has an opening across a width of the top portion and the pocket is configured to receive heating and/or cooling element; and at least one compartment coupled to the top portion, wherein the at least one compartment is permanently affixed to the top portion and is configured to be selectively coupled to the attachment mechanism of the bottom portion.

2. The neck pillow of claim 1, further comprising a coupling mechanism configured and disposed to affix the top portion to the bottom portion.

3. The neck pillow of claim 2, wherein the coupling mechanism comprises a hinge.

4. The neck pillow of claim 2, wherein the coupling mechanism comprises a fabric flap.

5. The neck pillow of claim 2, further comprising a fastening mechanism configured and disposed to secure the top portion to the bottom portion in a closed configuration.

6. The neck pillow of claim 5, wherein the fastening mechanism comprises a hook-and-loop fastener.

7. The neck pillow of claim 5, wherein the fastening mechanism comprises a snap.

8. The neck pillow of claim 5, wherein the fastening mechanism comprises a zipper.

9. The neck pillow of claim 5, further comprising a pliable member disposed within the neck pillow.

10. The neck pillow of claim 9, wherein the pliable member is comprised of metal.

11. The neck pillow of claim 9, wherein the pliable member is comprised of plastic.

12. The neck pillow of claim 9, wherein the pliable member is disposed around a contour of the neck pillow.

13. The neck pillow of claim 1, wherein the at least one compartment comprises a first compartment and a second compartment.

14. The neck pillow of claim 13, wherein the first compartment is disposed on a first side of the neck pillow and wherein the second compartment is disposed on a second side of the neck pillow.

15. The neck pillow of claim 1, wherein the pocket is a waterproof pocket.

16. The neck pillow of claim 1, further comprising a clip disposed on a rear portion of the neck pillow.

17. The neck pillow of claim 1, further comprising a loop disposed on a rear portion of the neck pillow.

18. The neck pillow of claim 1, comprising an outer surface comprised of plastic.

19. The neck pillow of claim 1, comprising an outer surface comprised of vinyl.

20. The neck pillow of claim 1, comprising an outer surface comprised of leather or silk.

21. The neck pillow of claim 1, comprising an outer surface comprised of cotton.

22. The neck pillow of claim 1, comprising an outer surface comprised of wool.

23. The neck pillow of claim 1, comprising a fill material comprised of foam.

24. The neck pillow of claim 23, wherein the foam includes a polyurethane foam.

25. The neck pillow of claim 23, wherein the foam includes a urethane foam.

26. The neck pillow of claim 1, further comprising a strap coupled to a first point and a second point on the neck pillow.

27. The neck pillow of claim 26, wherein the strap is configured to secure a position of the neck pillow in relation to a secondary object.

* * * * *